US005503237A

United States Patent [19]

Neukirchen

[11] Patent Number: 5,503,237

[45] Date of Patent: Apr. 2, 1996

[54] HELICAL DRILL

[75] Inventor: Axel Neukirchen, Munich, Germany

[73] Assignee: Hilti Aktiengesellschaft, Schaan, Liechtenstein

[21] Appl. No.: 338,065

[22] Filed: Nov. 14, 1994

[30] Foreign Application Priority Data

Nov. 11, 1993 [DE] Germany ..... 43 38 490.0

[51] Int. Cl.[6] ..... E21B 10/44; E21B 17/22

[52] U.S. Cl. ..... 175/323; 175/394; 408/230

[58] Field of Search ..... 175/394, 323, 175/415; 408/230

[56] References Cited

U.S. PATENT DOCUMENTS

| | | | |
|---|---|---|---|
| 1,307,525 | 6/1919 | Trebert | 175/394 X |
| 1,955,768 | 4/1934 | Powell | 175/394 X |
| 3,147,646 | 9/1964 | Rawcliffe, Jr. | 408/230 |
| 3,667,857 | 6/1972 | Shaner et al. | 408/230 |
| 4,285,618 | 8/1981 | Shanley, Jr. | 408/230 X |
| 4,953,642 | 9/1990 | Skaggs | 175/394 X |

FOREIGN PATENT DOCUMENTS

| | | | |
|---|---|---|---|
| 493510 | 5/1950 | Belgium | 175/323 |
| 2013327 | 12/1971 | Germany . | |
| 283809 | 11/1988 | Japan | 408/230 |
| 581520 | 11/1976 | Switzerland | 408/230 |

*Primary Examiner*—Hoang C. Dang
*Attorney, Agent, or Firm*—Anderson Kill Olick & Oshinsky

[57] ABSTRACT

A rock drill is formed of an axially extending shank (2) with a drill head (1) at one end and chuck end (3) at the other end. The axially extending outside surface of the shank has at least one helically extending conveying groove (4, 5) and at least one helically extending land (6, 7). The land (6, 7) forms the radially outer surface of the shank (2). Grooves (8, 9) extending perpendicularly of the shank axis are formed in the surface of the land.

6 Claims, 1 Drawing Sheet

HELICAL DRILL

BACKGROUND OF THE INVENTION

The present invention is directed to a rock drill with an axially extending shank having a drill head at one end and a chuck end at the other, the shank comprises at least one conveying helical groove in its outside surface and a corresponding helical land forming the outside diameter of the shank with other grooves located in the land.

The conveying helical grooves in the shank of known drills transport the drillings removed during the drilling operation analogous to a conveying worm, moving the drillings from the deepest part of the borehole to the outside. At the present time such rock drills are used in ever smaller drilling tools where the output is increased by striker or impact energy. The rotational power requirement resulting from, among other things, friction between the land of the conveying groove and the borehole wall has remained essentially constant, since a reduction of the total land width of such drills would have a detrimental effect on the guidance of the rock drill in the material in which it is used.

There is a known rock drill in DE-AS 20 13, 327 where the shank has a conveying groove with a land having other grooves arranged to be spaced in the circumferential direction and inclined with respect to the axis of the drill.

In the broadest sense, this known rock drill has a reduction in the land surface cooperating with the borehole wall. A power gain obtained by less friction of the land against the borehole gain obtained by less friction of the land against the borehole wall due to the smaller land surface is lost in that the protuberant part of the other grooves shape, due to the hang-up with the in part rough surface of the borehole wall, thus increases the overall friction of the rock drill.

SUMMARY OF THE INVENTION

Therefore, the primary object of the present invention is to provide a rock drill with a conveying helical groove which ensures good guidance of the drill in a borehole during the drilling operation and, at the same time, reduces the friction at the borehole wall.

In accordance with the present invention, the other grooves in the land or lands extend substantially at right angles to the central axis of the shank.

Because of the rectangular arrangement of the grooves in the land of the conveying helical groove, the entire width of the land is maintained. The lands are penetrated by a plurality of grooves spaced from one another in the axial direction with the result that the entire land surface does not bear against the borehole wall during the drilling operation. Due to this arrangement of the present invention there are no protruding parts of the grooves which can coact with the rough surfaces of the borehole wall in such a way that any reduction of power gained is nullified.

The width of the land extending along the conveying helical grooves is constant for the entire length of the groove for manufacturing and economic reasons. The grooves formed in the lands extending along the conveying helical groove are preferably disposed in such a way that they are arranged consecutively in equal spacing along the central axis of the shank.

The amount of the friction developed during a drilling operation depends on the diameter of the shank. A rock drill with a larger diameter has a larger circumference and, therefore, has conveying helical grooves with larger land surfaces. As a result, the width of the grooves in the land are also a function of the external diameter of the shank. The ratio between the width of the land grooves and the diameter of the shank is in the range of 0.05:1 to 0.3:1.

To avoid any harmful effect on the removal of the drillings by the conveying helical grooves, the grooves in the land are shaped to have a depth so that the groove base is only slightly radially inward with respect to the surface of the land. The depth of the land grooves must in any case be arranged so that the plurality of the particles of the drillings is larger than the depth of the grooves. Since the particle size of the drilling is dependent on the diameter of the rock drill shank, the depth of groove has a ratio with respect to the outside diameter of the shank preferably in the range of 0.02:1 to 0.05:1.

Depending upon the type of material being drilled, the width of the land grooves relative to the width of the land in the outside surface of the shank can be configured in different ways. When material having a high friction between the lands and the borehole wall are being worked, it is preferably if the grooves in the lands of the conveying helical grooves are wider, so that less land surface comes into contact with the borehole wall. When hard materials are being worked, the grooves need smaller widths. The ratio of the width of the groove and the width of the land of the conveying helical groove amounts expediently to the range of 0.8:1 to 6:1.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
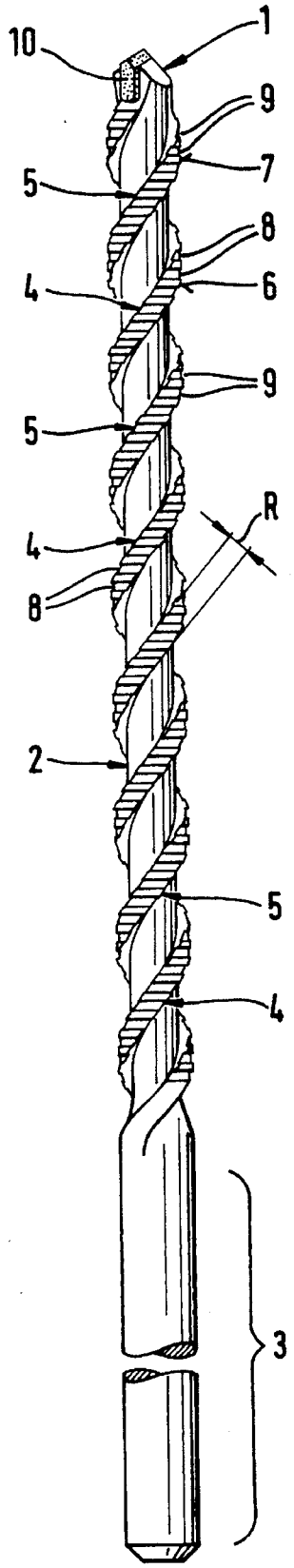
FIG. 1 is an axially extending elevational view of a rock drill embodying the present invention and illustrated in a simplified manner.
Figure 2:
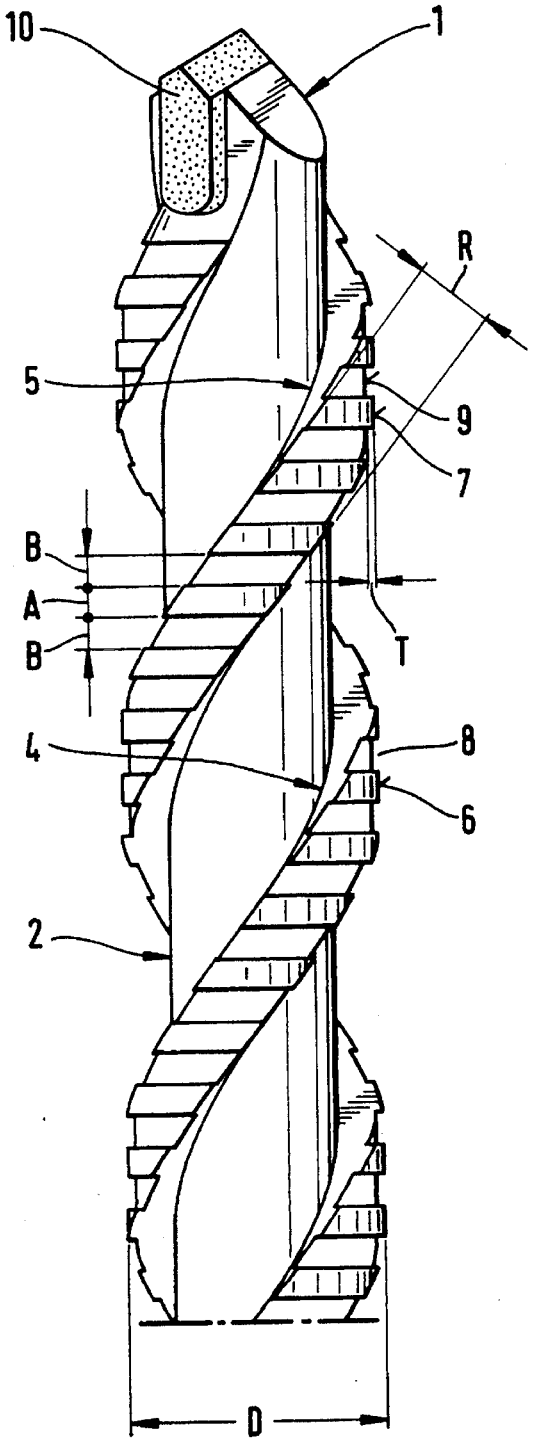
FIG. 2 is an enlarged elevational view of the drilling end of the rock drill illustrated in FIG. 1.

In FIGS. 1 and 2 a rock drill is illustrated with an axially extending shank 2 with a drill head 1 at one end of the shank and chuck end 3 at its opposite end. The shank has two conveying helical grooves 4, 5 in its outside surface with lands 6, 7 separating the helical grooves 4, 5 and forming the outside surface and diameter of the shank. As shown best in FIG. 2, second grooves 8, 9 are formed in the lands 6, 7. The second grooves 8, 9 extend substantially at right angles to the axis of the rock drill and are spaced apart from one another. A hard metal plate 10 is soldered into the drill head 1 with the outside diameter of the metal plate extending slightly outwardly from the outside diameter of the shank 2.

FIG. 2 provides an enlarged view of the helically extending lands 6,7 of the conveying helical grooves 4, 5 with the second grooves 8, 9 traversing the lands. Second grooves 8, 9 are spaced apart at equal intervals A along the central axis of the shank 2. The second grooves 8, 9 are rectangularly shaped with opposite sides extending in planes perpendicular to the axis of the shank 2. The base of the second grooves 8, 9 extends perpendicularly to the sides and parallel to the axis of the shank 2. Width B of the second grooves 8, 9 depends upon the width R of the lands separating the conveying helical grooves 4, 5, note FIG. 2. The depth uniform T of the second grooves 8, 9 depends upon the outside diameter D of the shank 2.

While a specific embodiment of the invention has been shown and described in detail to illustrate the inventive principles, it will be understood that the invention may be embodied otherwise without departing from said principles.

I claim:

1. Rock drill comprising an axially extending shank (2) having a central axis and an axially extending outside surface with an outside diameter (D), drilling head (1) at one end of said shank and a chuck end (3) at the opposite end thereof, said shank having at least one conveying first groove (4, 5) extending helically in the central axis direction and extending inwardly from the outside surface thereof from adjacent said drilling head (1) toward said chuck end (3), and said outside surface comprising at least one helically extending land (6, 7), said land (6, 7) having second grooves (8, 9) therein, wherein the improvement comprises that said second grooves (8, 9) extend perpendicularly to the central axis of said shank, said second grooves (8, 9) are rectangularly shaped having sides extending perpendicularly to the central axis of said shank (2) and a base extending perpendicularly to said sides.

2. Rock drill, as set forth in claim 1, wherein said second grooves (8, 9) are equidistantly spaced apart along the central axis direction of said shank (2) and have a uniform depth (T) and a uniform width (B).

3. Rock drill, as set forth in claim 1 or 2, wherein the ratio between the width (B) of the second groove (8, 9) and the outside diameter (D) of said shank (2) is in the range of 0.05:1 to 0.3:1.

4. Rock drill, as set forth in claim 1 or 2 wherein the ratio between the depth (T) of the second groove (8, 9) and the outside diameter (D) of said shank (2) is in the range of 0.02:1 to 0.05:1.

5. Rock drill, as set forth in claim 1 or 2, wherein the ratio between the width (B) of the second groove (8, 9) and the width (R) of the land (6, 7) of the conveying first grooves (4, 5) is in the range of 0.8:1 to 6:1.

6. Rock drill, as set forth in claim 2, wherein said outside surface of said shank has two said conveying helical first grooves (4, 5) and two said helical lands (6, 7) separating said first grooves, the ratio of the width (B) of the second grooves and the outside diameter (D) of said shank (2) is in the range of 0.05:1 to 0.3:1, the ratio of the depth (T) of the second groove (8, 9) and the outside diameter (D) of the shank (2) is in the range of 0.02:1 to 0.05:1, and the ratio between the width (B) of the second groove (8, 9) and the width (R) of the lands (6, 7) of the first grooves (4, 5) is in the range of 0.8:1 to 6:1.

* * * * *